US006340814B1

(12) United States Patent
Vandermey

(10) Patent No.: US 6,340,814 B1
(45) Date of Patent: Jan. 22, 2002

(54) MASS SPECTROMETER WITH MULTIPLE CAPACITIVELY COUPLED MASS ANALYSIS STAGES

(75) Inventor: John Vandermey, Georgetown (CA)

(73) Assignee: Sciex, A division of MDS Inc., Concord (CA)

( * ) Notice: Subject to any disclaimer, the term of this patent is extended or adjusted under 35 U.S.C. 154(b) by 0 days.

(21) Appl. No.: 09/353,090

(22) Filed: Jul. 15, 1999

(51) Int. Cl.[7] ..... H01J 49/42
(52) U.S. Cl. ..... 250/292; 250/281
(58) Field of Search ..... 250/292, 281

(56) References Cited

U.S. PATENT DOCUMENTS

| | | | | |
|---|---|---|---|---|
| 4,234,791 A | | 11/1980 | Enke et al. | 250/281 |
| 4,329,582 A | | 5/1982 | French et al. | 250/292 |
| 6,111,250 A | * | 8/2000 | Thomson et al. | 250/292 |
| 6,191,417 B1 | * | 2/2001 | Douglas et al. | 250/292 |
| 6,194,717 B1 | * | 2/2001 | Hager | 250/292 |

FOREIGN PATENT DOCUMENTS

JP 10-214591 8/1998

OTHER PUBLICATIONS

Du, Zhaohui et al, "Inductively Coupled Plasma Mass Spectrometry. . . Third Stability Region", J. Am. Soc. Mass Spectrum, 8, 1230, 1997.

Konenkov, N.V., "Coupling the Analyzers of Tandem Quadrupole Mass Filters", Journal of Technical Physics, vol. 60, N 10, 153–157, 1990.

Konenkov, N.V., "Coupling Mass Filters of the Tandem Quadrupole Mass Spectrometer", Journal of Technical Physics, vol. 61, N 12, 120–125, 1990.

Konenkov, N.V. and Kratenko, V.I., "Characteristics of a quadrupole mass filter in the separation mode of a few stability regions", International Journal of Mass Spectrometry and Ion Processes, 108, 115, 1991.

White, F.A. et al, "A Two Stage Magnetic Analyzer for Isotopic Ratio. . . ", Second Annual Meeting of ASTM Committee E–14 on Mass Spectrometry, New Orleans, 1954.

Wilson, H.W. et al, "Two Stage Mass Spectrometer for Nuclear Physics Application", Nuclear Instruments and Methods, 13, 269, 1961.

* cited by examiner

*Primary Examiner*—Kiet T. Nguyen
(74) *Attorney, Agent, or Firm*—Bereskin & Parr

(57) ABSTRACT

A mass spectroscopy apparatus having two quadrupole mass analyzer stages is disclosed. Both stages are configured to transmit ions of the same mass to charge ratio and they are operated in series to provide a tandem mass analyzer having greater resolution than either stage has separately. The poles of the two quadrupoles are positioned axially and close together to minimize ion loss between the two stages. The RF component of the potential across the two stages are kept in phase such that some poles of the first stage are always 180° out of phase with some poles of the other stage. Capacitors are provided to couple the out of phase poles of the two stages to one another, thereby compensating for a stray capacitance which arises between the in phase poles of the two stages.

9 Claims, 11 Drawing Sheets

MASS SPECTROMETER WITH MULTIPLE CAPACITIVELY COUPLED MASS ANALYSIS STAGES

FIELD OF THE INVENTION

This invention relates generally to mass spectrometers having multiple mass analysis stages and more particularly is concerned with coupling the multiple mass analysis stages to minimize the effects of stray capacitances between the stages, especially when the stages are positioned close together.

BACKGROUND OF THE INVENTION

The use of multiple quadrupole rod sets in a mass spectrometer is known. Conventionally, each quadrupole rod set has its own function. Where an individual quadrupole rod set is used as a mass analyzer, its function is often independent of the function of adjacent rod sets.

For example, U.S. Pat. No. 4,234,791 Nov. 18, 1980, "Tandem Quadrupole Mass Spectrometer for Selected Ion Fragmentation Studies and Low Energy Collision Induced Dissociator Therefor" describes a system comprising three sets of quadrupoles in series, a configuration commonly referred to as a triple quadrupole. A first quadrupole mass analyzer selects an ion of one particular mass to charge ratio (m/e) from a mixture produced in an ion source. These selected ions then collide with a gas in a second quadrupole operated in an RF mode only. The collisions transfer translational energy to internal energy of the ions, causing the ions to fragment. A mass spectrum of the fragment ions is then obtained with a third quadrupole. The first and third quadrupoles operate with selected RF and DC voltages to give the desired mass resolution.

It has been found that a combination of several quadrupole rod sets in tandem, all operating as mass analyzers and all configured to select the same ion, can, in certain circumstances, provide a higher resolution mass analyzer. Such a configuration is disclosed in U.S. patent application Ser. No. 09/188,352. It was found preferable to position the adjacent rod sets close to one another, with no physical lens separating them. The need for this is further described below.

With the quadrupoles placed close together and with no lens between the quadrupoles it was found that capacitance coupling of the RF between the quadrupoles caused problems with the control circuits. There are many known quadrupole designs which have multiple rod sets, which are mounted close to one another. However, the problem of capacitance coupling between rod sets is not usually a problem for a number of reasons. Often one rod set is larger than another, so that the larger rod set at least will not sense any significant effect from a field from a smaller rod set. In many cases, the RF drive for one rod set is derived by a capacitance connection with another rod set or its RF driver circuit, so that adjacent rod sets are, in any event, coupled in a controlled manner. In some cases the quadrupoles operate at different frequencies so that one quadrupole power supply is not sensitive to electrical pick-up from another. Also, for many quadrupole designs, one rod set is often enclosed in a chamber, with lens at either end, so that it can be operated at a different pressure from adjacent rod sets. The lenses at either end serve not only to isolate the different pressure regions but also to provide isolation or separation between fields of the different rod sets.

Thus, in known designs, problems due to close coupling have in general not been significant. In the case of the instant device, when two quadrupole mass analyzers were positioned in close proximity, it was found that the RF field of one quadrupole power supply interfered with the second power supply due to a capacitance effect between adjacent rods.

SUMMARY OF THE INVENTION

The present invention provides a method of reducing the effects of stray capacitance between adjacent quadrupole rod sets being operated in series in mass analyzer mode to provide, in combination, a more precise mass analyzer.

In accordance with the present invention, there is provided a mass spectrometry apparatus comprising: (a) first and second multipole rod sets, each of said first and second multipole rod set having (i) two or more positive rods, all of the positive rods being coupled together and (ii) two or more negative rods, all of the negative rods being coupled together, (b) a first voltage generator coupled to the positive and negative rods of said first multipole rod set for generating a potential in the first multipole rod set, (c) a second voltage generator coupled to the positive and negative rods of said second multipole rod set for generating a potential in the second multipole rod set, (d) a first capacitor coupled between the positive rods of said first multipole rod set and the negative rods of said second multipole rod set, and (e) a second capacitor coupled between the negative rods of said first multipole rod set and the positive rods of said second multipole rod set.

BRIEF DESCRIPTION OF THE DRAWINGS

For a better understanding of the present invention and to show more clearly how it may be carried into effect, reference has been made, by way of example, to the accompanying drawings, in which.

DETAILED DESCRIPTION OF THE INVENTION

Figure 1:
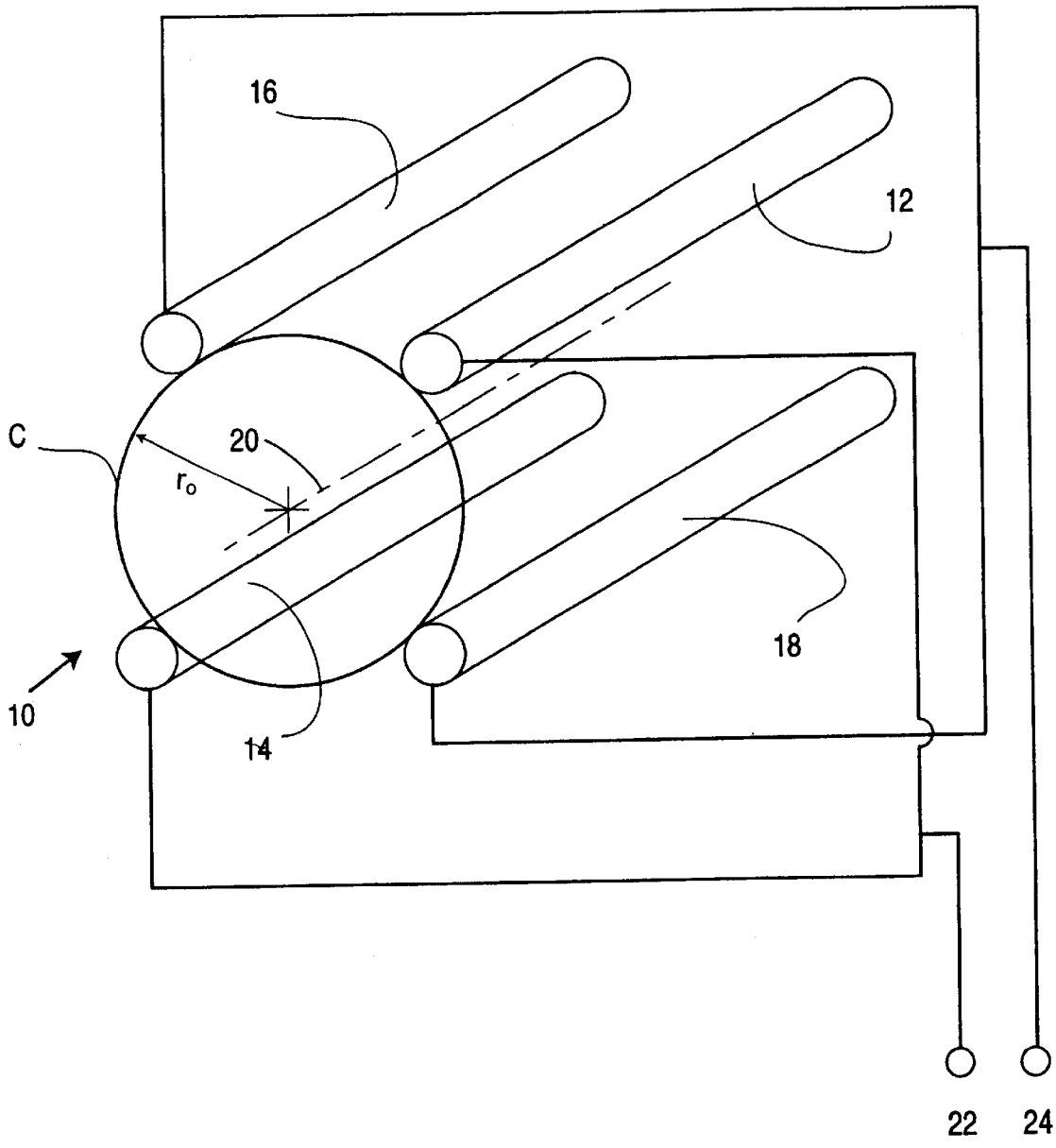
FIG. 1 is a schematic perspective view of a set of quadrupole rods.

Referring first to FIG. 1, a quadrupole rod set 10 representative of quadrupoles used in quadrupole mass spectrometers is shown in schematic form. The housing and support apparatus of quadrupole rod set 10 is not shown for clarity. Quadrupole rod set 10 is well known and is described, for example, in U.S. Pat. No. 2,939,952 to Paul et. al. Although quadrupole rod set 10 is shown having 4 electrodes or "rods", it will be appreciated that more rods may be used if desired, and the invention is equally applicable to higher order multiples.

Quadrupole rod set 10 comprises rods 12, 14, 16 and 18. Rods 12, 14, 16 and 18 are arranged symmetrically around axis 20 such that the rods inscribe a circle C having a radius $r_0$. The cross section of rods 12, 14, 16 and 18 is preferably hyperbolic, although rods of circular cross-section are commonly used. As is conventional opposite rods 12 and 14 are coupled together and brought out to a terminal 22 and opposite rods 16 and 18 are coupled together and brought out to a terminal 24. An electrical potential is applied across terminals 22 and 24. For mass resolution, the potential applied has both a DC and an AC component. The AC components will normally be in the RF range, typically about 1 MHz. As is known, in some cases just an RF voltage is applied. The rods sets to which the positive DC potential is coupled may be referred to as the positive rods and those to which the negative DC potential is coupled may be referred to as the negative rods.

Ions to be mass analyzed are injected along the axis of the quadrupole and in general have complex trajectories, which may be described as either stable or unstable. For a trajectory to be stable, the amplitude of the ion motion in the plane normal to the axis of the quadrupole must remain less than $r_0$. Ions with a stable trajectory will travel along the axis of quadrupole rod set 10 and will be transmitted from the quadrupole to another processing stage or to a detection device. An ion with an unstable trajectory will collide with a rod or with the housing of quadrupole rod set 10 and will not be transmitted. The motion of a particular ion is controlled by the Mathieu parameters a and q of the mass analyzer. These parameters are related to the characteristics of the potential applied across terminals 22 and 24 as follows:

$$a = \frac{8eU}{m\omega^2 r_0^2} \quad \text{and} \quad q = \frac{4eV}{m\omega^2 r_0^2} \tag{1}$$

where e is the charge on an ion, m is the ion mass, $\omega=2\pi f$ where f is the RF frequency, U is the DC voltage from a pole to ground and V is the zero to peak RF voltage from each pole to ground. Combinations of a and q which give stable ion motion in both the x and y directions are usually shown on a stability diagram like that of FIG. 2. The notation of FIG. 2 for the regions of stability is taken from Quadrupole Mass Spectrometry and its Applications, P. H. Dawson ed., Elsevier Amsterdam, 1976. The "first" stability region refers to the region near (a,q)=(0.2, 0.7), the "second" stability region refers to the region near (a,q)=(0.02, 7.55) and the "third" stability region refers to the region near (a,q)=(3,3). It is important to note that there are many regions of stability (in fact an unlimited number). Selection of the desired stability regions, and selected tips or operating points in each region, will depend on the intended application.

Figure 3A:
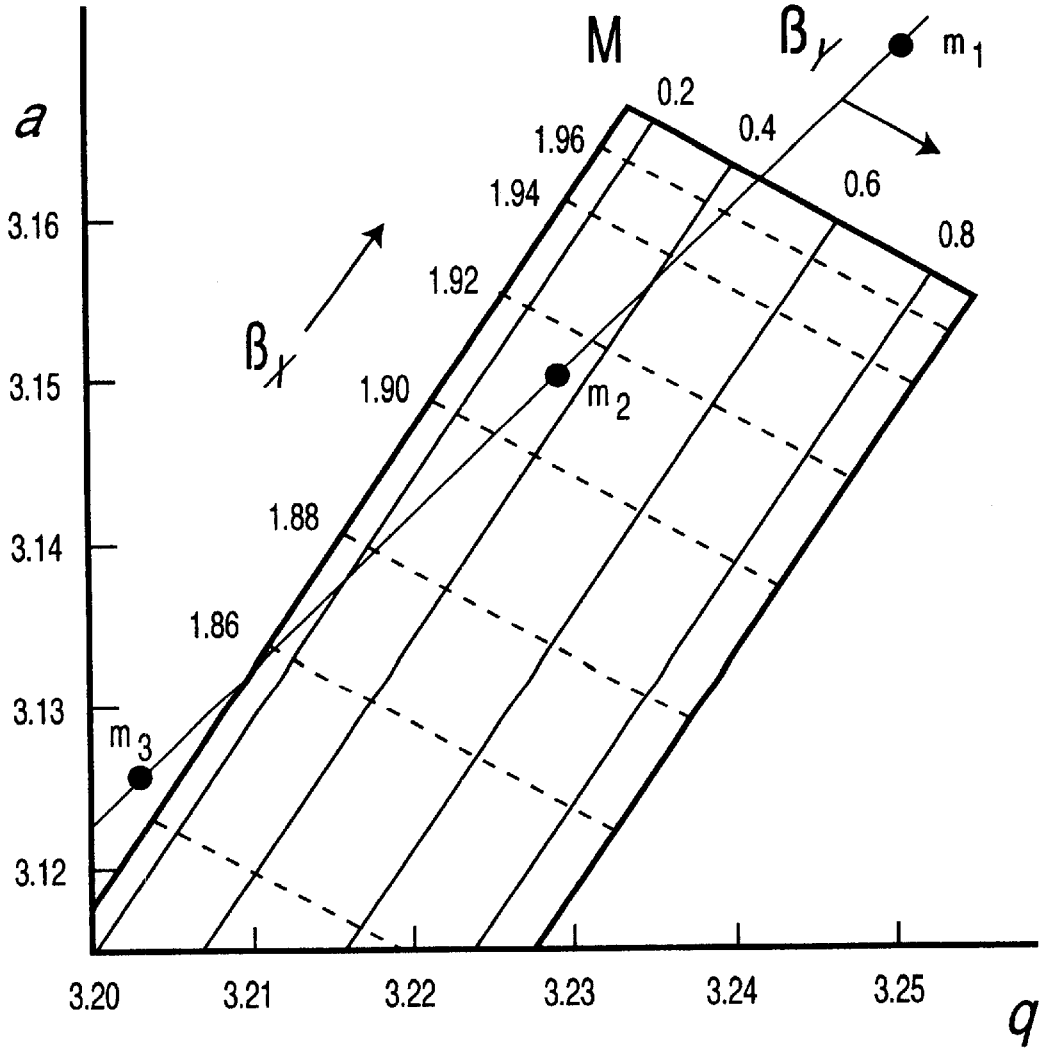
FIGS. 3*a* and 3*b* are enlarged portions of a third stability region indicated at III in FIG. 2.
Figure 3B:
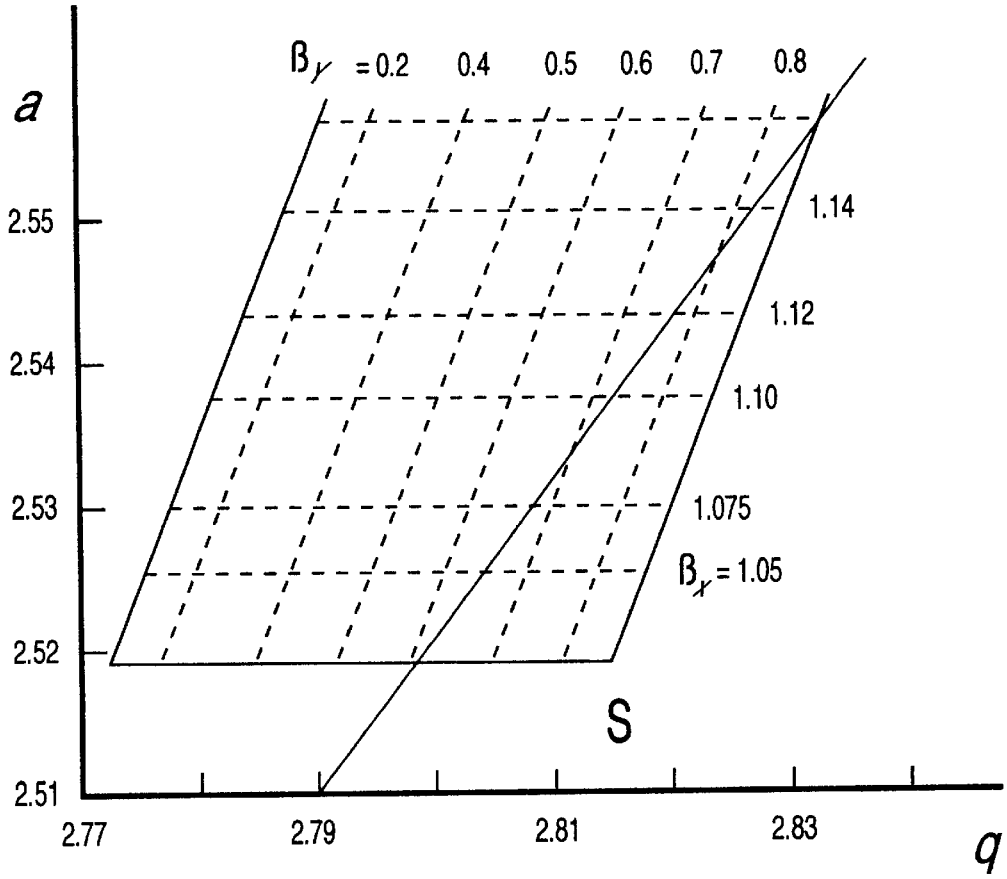

Mass analysis is usually obtained by selecting the magnitude of the DC and RF voltages applied to the quadrupole so that an ion of interest is near the tip of a stability region. For example, FIG. 3*a* shows that when an ion of mass $m_2$ is at the upper tip of the third stability region lighter ions of mass $m_1$ and heavier ions of mass $m_3$ are outside the stability region and are not transmitted (here, reference to "mass" is shorthand for the mass to charge ratio m/e). Thus the ion of mass $m_2$ is separated from the ions of mass $m_1$ and $m_3$. The line connecting $m_1$, $m_2$ and $m_3$ is an operating line for a fixed ratio of a:q, indicative of the ratio of the selected operating voltages, and any ion will be on this line as determined by its mass to charge (m/e) ratio. For the third stability region mass analysis can be obtained with operation at the upper tip or lower tip and FIG. 3*b* shows an operating line for operation at the lower tip (see for example "Inductively Coupled Plasma Mass Spectrometry with a Quadrupole Operated in the Third Stability region" by Zhaohui Du, Terry Olney, and D. J. Douglas published in The Journal of the American Society for Mass Spectrometry, 8,1230–1236, Dec. 1997).

The resolution of a quadrupole mass filter is normally changed by changing the ratio of DC voltage (U) to RF voltage (V). If for example a higher ratio of U/V is used, the ratio a/q increases, i.e. the slope of the operating line increases. In FIG. 3*a* this would place $m_2$ closer to the tip of the stability diagram and the range of masses around $m_2$ that is transmitted will decrease. Thus the mass resolution is increased.

Various definitions of resolution can be used. Here we use the definition of resolution at half height $R_{1/2}$ given by $$R_{1/2} = \frac{m}{\Delta m_{1/2}} \tag{2}$$

where m is the mass to charge (m/e) ratio of a peak in the mass spectrum and $\Delta m_{1/2}$ is the peak width measured at a mass to charge ratio where the intensity is half the maximum height. While high resolution is desirable in a mass spectrometer it is important to recognize that there are other figures of merit for a peak in a mass spectrum such as the extent to which it tails to adjacent peaks.

In the article "Inductively Coupled Plasma Mass Spectrometry with a Quadrupole Operated in the Third Stability region" by Zhaohui Du et al., cited above, it was shown that with operation of the quadrupole in the third stability region the peaks of a mass spectrum can have unusually sharp sides on both the high and low mass sides. However this is only possible with low energy ions (2–5 eV in the cited work). At higher ion energies the peaks form tails and this behaviour is detailed below in relation to FIGS. 4 and 5.

Figure 4:
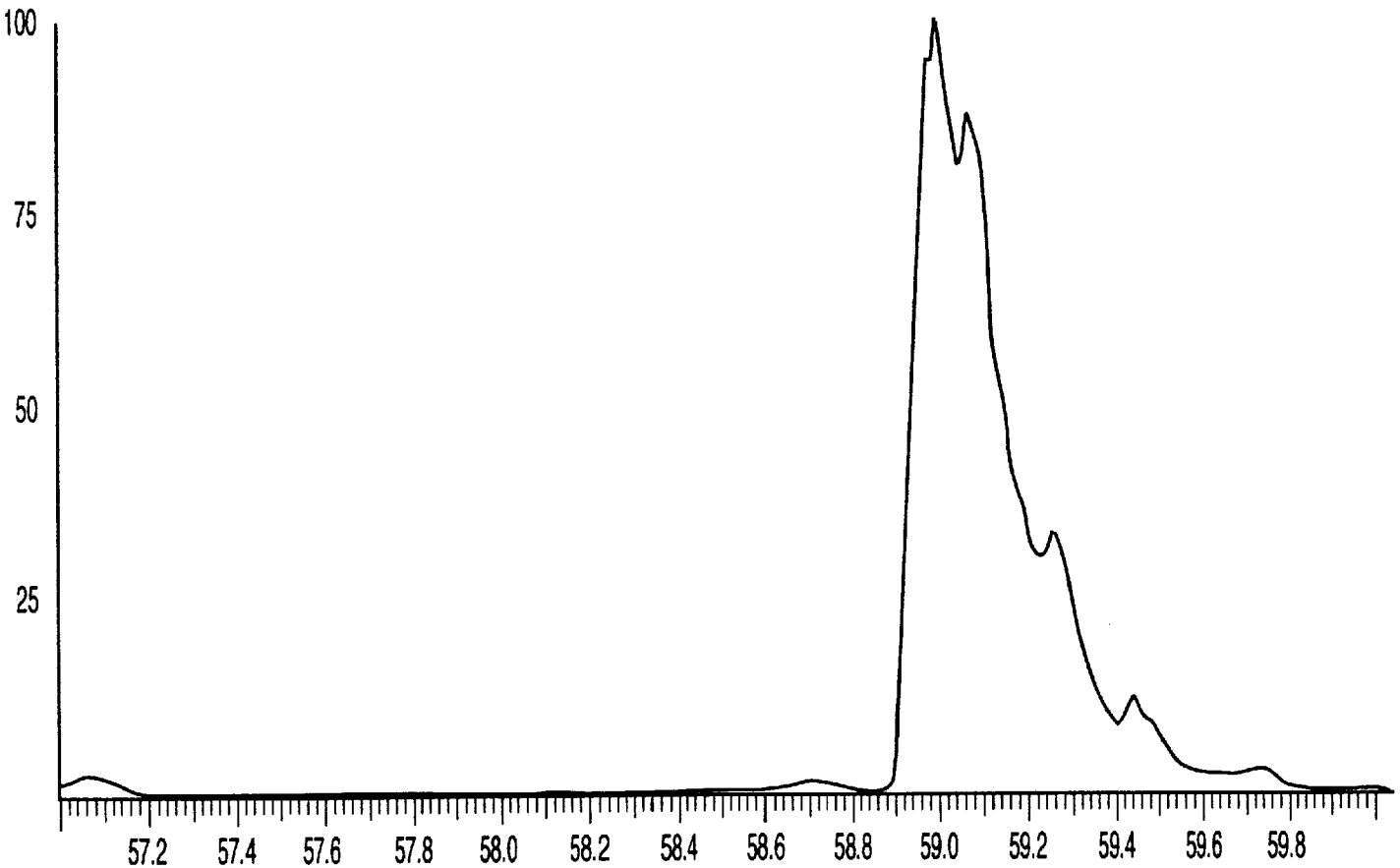
FIG. 4 shows the peak shape obtained with operation of a single quadrupole at the upper tip of the third region.
Figure 5:
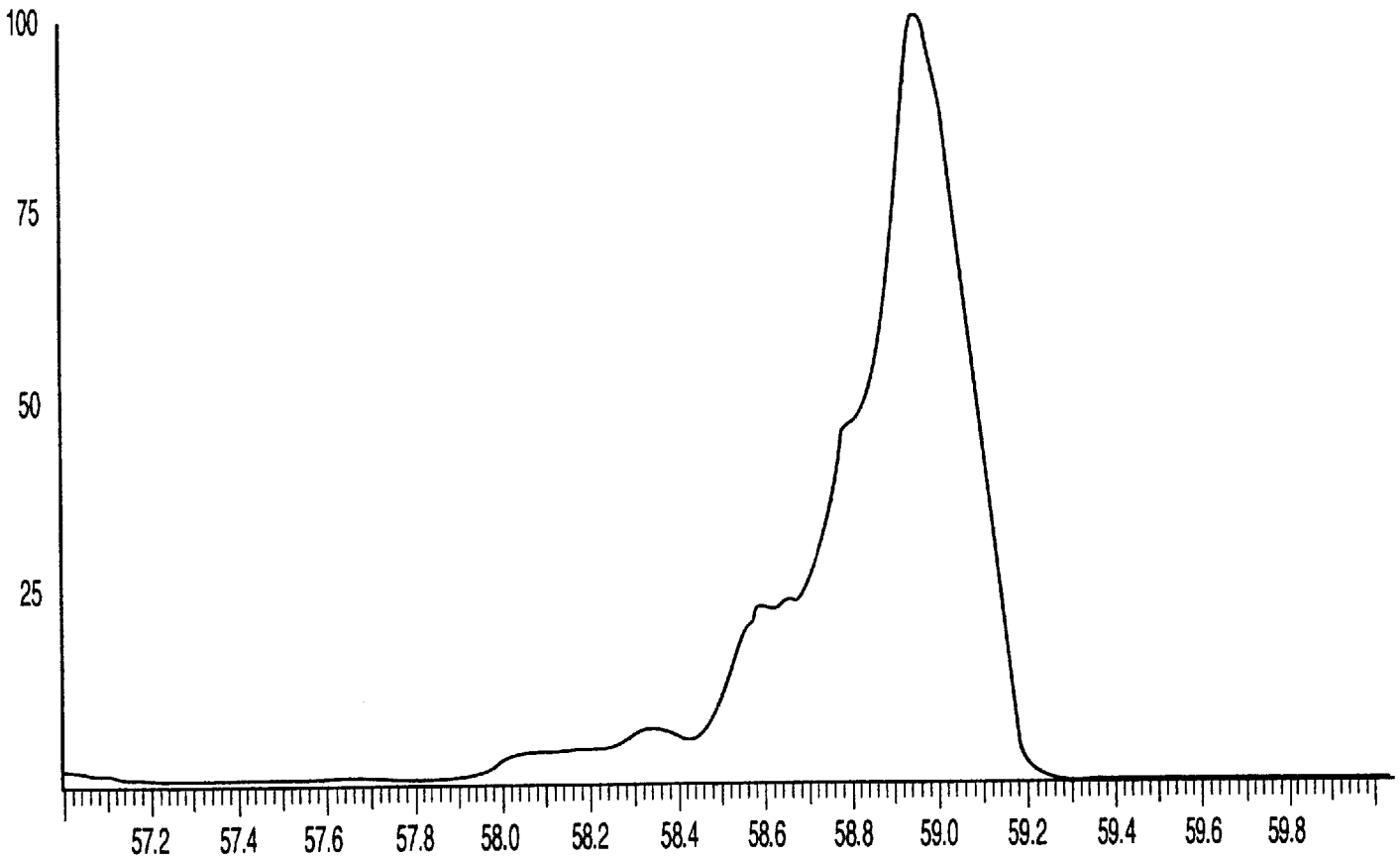
FIG. 5 shows the peak shape obtained with operation of a single quadrupole at the lower tip of the third region.

FIG. 4, for example, shows the peak shape obtained with operation at the upper tip of the third stability region, i.e. as in FIG. 3*a*, and with ca. 120 eV $Co^0$+ions (m/e=59). It can be seen that there is a long "tail" on the high mass side of the peak, although the peak retains a relatively sharp cut-off on the low mass side. Similarly, FIG. 5 shows the peak shape obtained with operation at the lower tip, i.e. as in FIG. 3*b*, with 110 eV $Co^0$+ions. It is seen that there is a long tail on the peak, but here it is on the low mass side and the high mass side that has a relatively sharp cutoff.

Figure 6:
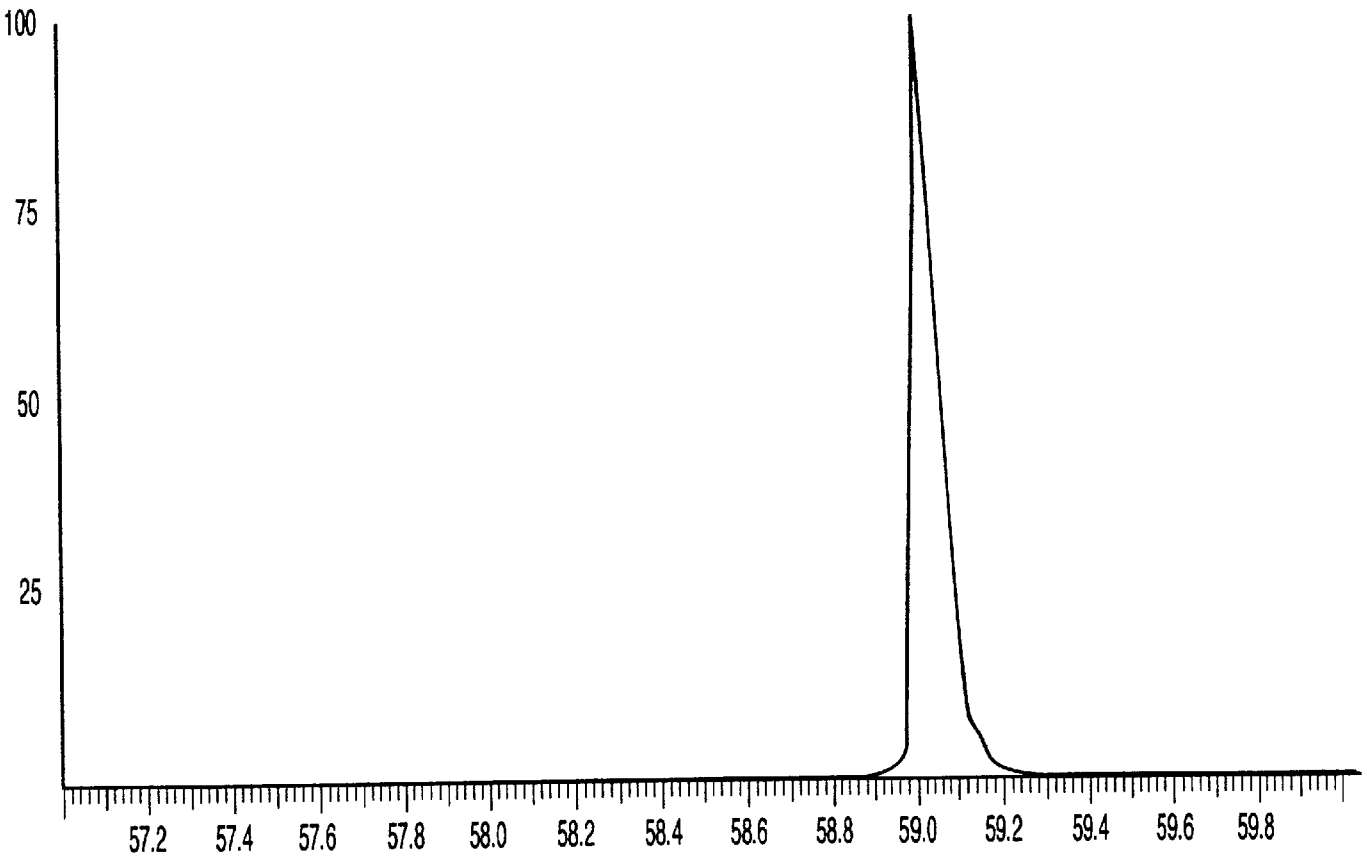
FIG. 6 shows the peak shape obtained with combined operation of two quadrupoles at the upper and lower tips of the third region.

It has been found that the use of two quadrupole rod sets in tandem, all operating in mass analyzing mode and configured to select the same ion, can provide a higher resolution mass analysis spectrometer with substantially sharper peaks. To eliminate the tails of FIGS. 4 and 5, two quadrupoles were operated in tandem and this has been demonstrated with $Co^0$+ions that had 120 eV energy in the first quadrupole and 110 eV energy in the second quadrupole. The first was operated at the upper tip with a peak shape like that of FIG. 4 and the second was operated at the lower tip with a peak shape like that of FIG. 5. The quadrupoles were scanned together and produced the peak shape of FIG. 6. It is seen that the peak is narrower than the peak produced by either the first quadrupole or the second quadrupole alone. It is also seen that there is no tailing on either side of the peak. This is detailed further in pending U.S. patent application Ser. No. 09/188,352, referred to above.

Figure 7A:
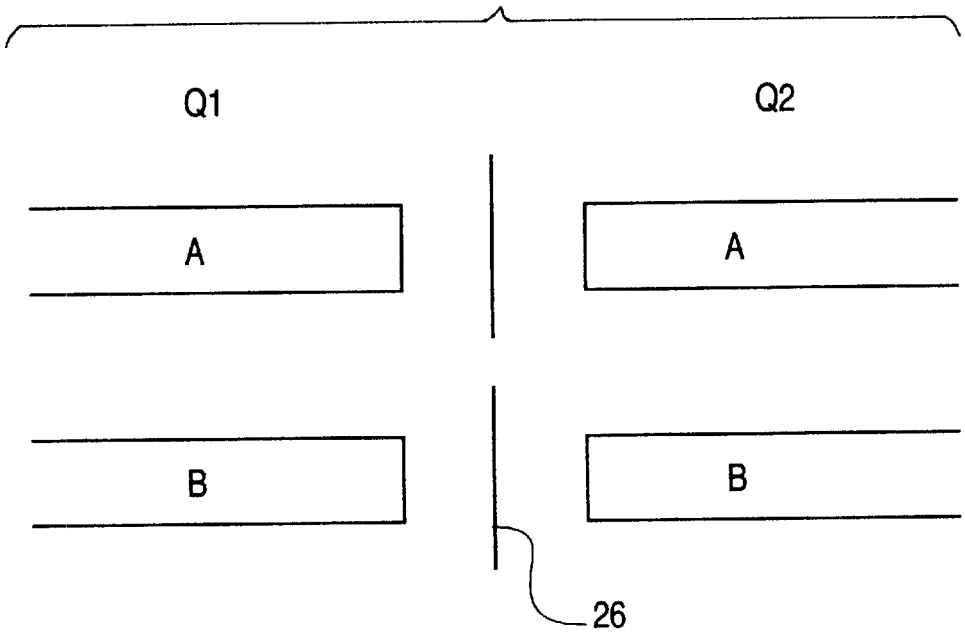
FIG. 7*a* shows schematically the arrangement of a tandem quadrupole with an aperture lens between the quadrupoles.
Figure 7B:
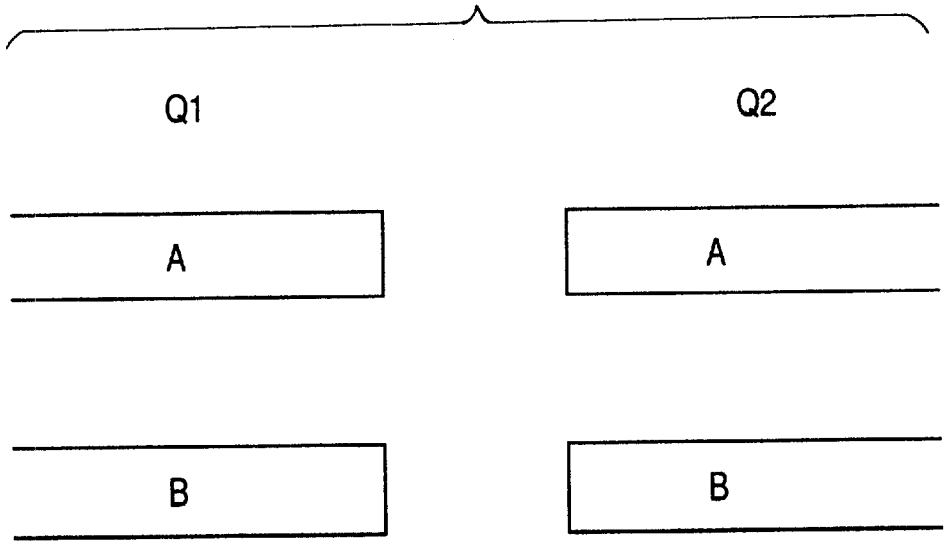
FIG. 7*b* shows schematically the arrangement of a tandem quadrupole without an aperture lens between the quadrupoles.

A first set of experiments to demonstrate the feasibility of operating tandem quadrupoles was carried out with the apparatus of FIG. 7*a*. Two quadrupoles, identified as Q1, Q2 in known manner, were placed in series and the A poles of the first quadrupole were aligned with the A poles of the second quadrupole. Ions leaving the first quadrupole passed through an aperture lens 26 into the second quadrupole, the lens 26 being conductive. The lens 26 shielded the RF circuit of each quadrupole from the RF of the other quadrupole. The diameter of the inscribed circle within the quadrupoles was 13.83 mm ($r_0$=6.915 mm). Lens aperture diameters of 11, 16, 22 and 30 mm were tested and all gave similar sensitivity. The rod sets were spaced with separation of 7 mm, i.e. about equal to $r_0$. Then the lens 26 was removed and the quadrupoles Q1, Q2 placed adjacent to each other again with a separation of 7 mm as shown in FIG. 7*b*.

With the quadrupoles placed close together, and with no lenses between the quadrupoles, the transmission or sensitivity of the tandem quadrupole mass analyzer was found to increase substantially. The sensitivity-resolution curves were measured for quadrupole spacings of 2.0, 3.0, 4.5 and 6 mm. It was found that decreasing the spacing from 6 mm to 2 mm caused a more than ten-fold increase in the sensitivity.

Figure 8:
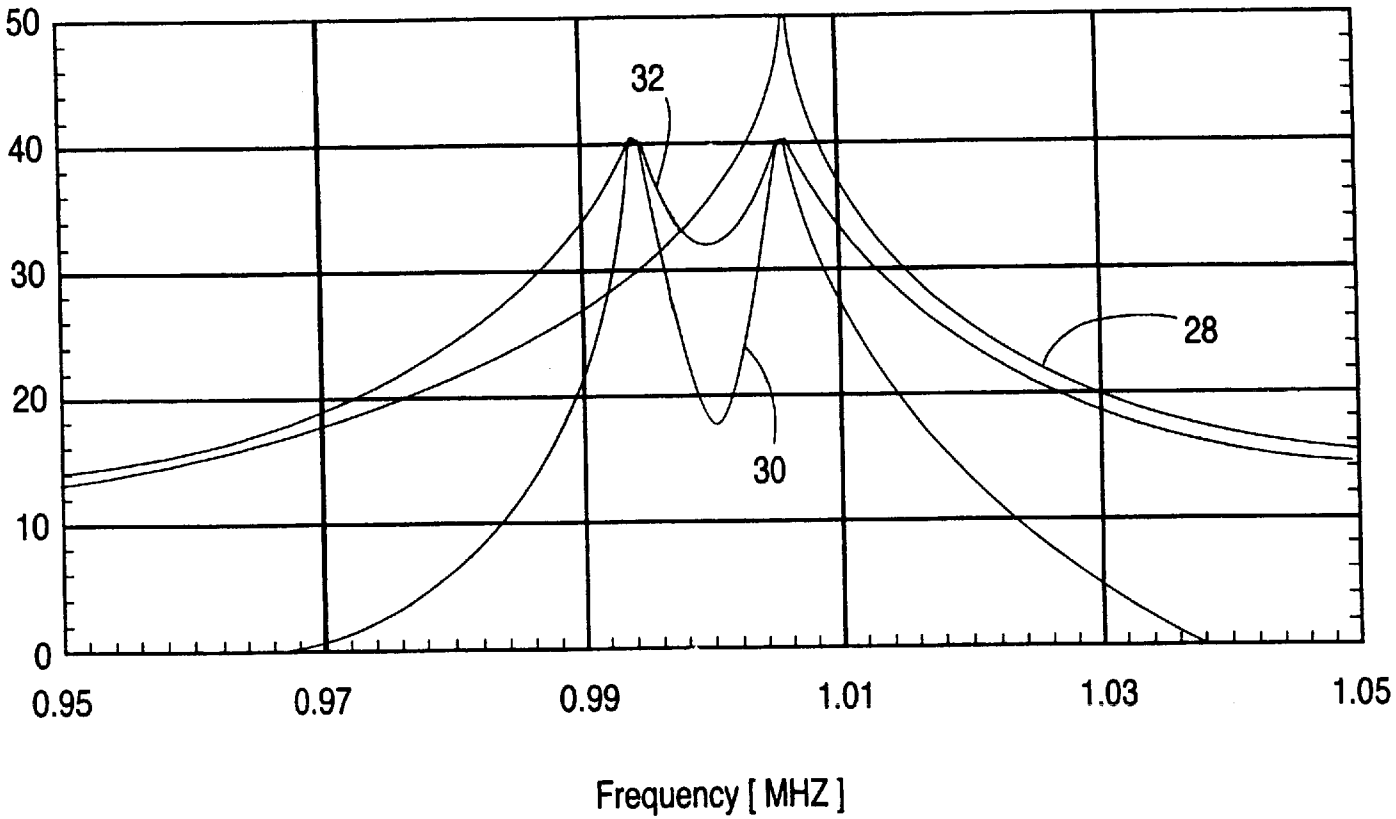
FIG. 8 shows the amplitude vs. frequency characteristics of a single quadrupole, a tandem quadrupole which has a stray capacitance and the induced voltage in the second quadrupole of a tandem quadrupole by the potential across its first quadrupole.

The potential applied across the rods of a quadrupole (i.e. across terminals 22 and 24) will generally comprise a DC component of several thousand volts and a RF component with a peak to peak voltage of up to 10,000 volts (measured from either pole to ground) and a frequency in the 1 MHz range. The power supply used to create this potential will generally incorporate a resonant circuit. The output voltage of the resonant circuit is multiplied by the quality factor of the circuit's inductor, allowing a low voltage, low power source to be used to generate thousands of volt-amperes at the quadrupole. The amplitude vs. frequency characteristic of a typical quadrupole power supply with a resonant frequency of 1 MHz is shown in FIG. 8 at 28.

If a second quadrupole having its own power supply is placed in tandem with the first, then a stray capacitance will exist between the resonant circuits of the two quadrupoles. Assuming a stray capacitance of 1 pf, the response curve of either of the power supplies is shown at 30. A double peak is introduced and the resonant frequency has fallen. If the power supply of the second quadrupole is turned off, the voltage induced in the second quadrupole by the potential of the first quadrupole is shown at 32. When both power supplies are operating, the RF voltage produced on the second quadrupole by the operation of the first power supply will also be produced on the first quadrupole by operation of the second power supply and the stray capacitance between the quadrupole rod sets.

Figure 9:
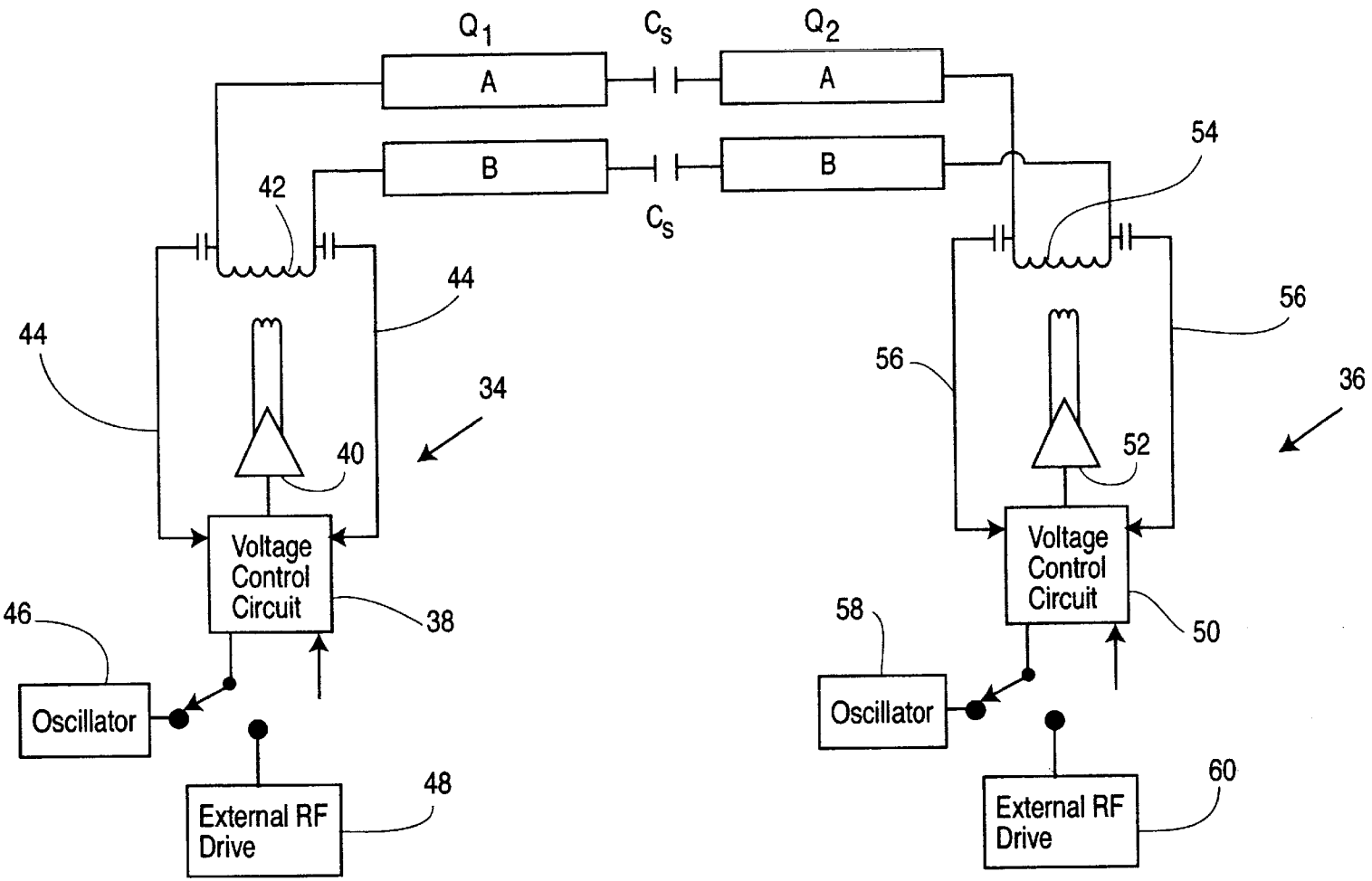
FIG. 9 is a schematic diagram showing a control circuit for a tandem quadrupole.

Referring to FIG. 9, each quadrupole rod set Q1, Q2 has a quadrupole RF power supply 34, 36. Each of quadrupole RF power supply 34, 36 has a low voltage control circuit, indicated at 38 and 50 followed by a respective RF power amplifier 40, 52, and a respective high Q resonance step up transformer 42, 54. The RF signal for the circuit is generated either by an internal oscillator 46, 58 or can be supplied by an external RF drive as indicated 48, 60. A small fraction of the output RF voltage is returned through a respective feedback circuit 44, 56 for comparison with the requested or set voltage. When the two quadrupoles are placed close together, with poles aligned, there is a stray capacitance $C_s$ between the ends of the A poles of quadrupole Q1 and the A poles of quadrupole Q2 and also a stray capacitance $C_s$ between the B poles of quadrupole Q1 and B poles of quadrupole Q2. As described above, these capacitances couple some of the RF potential of the rods from each quadrupole to the rods of the other. The feedback and control circuit of the quadrupole power supplies used were not designed to accommodate this. For example, if quadrupole Q1 is operated at high voltage and quadrupole Q2 at a lower voltage, the RF coupling between quadrupole Q1 and quadrupole Q2 induces a higher than expected voltage in the feedback circuit of quadrupole Q2 and the control circuitry fails. Additionally, the two RF signals might be at different frequencies. The cross coupling may result in an apparent frequency different than that of the RF power supply, affecting the stability of ions passing through the quadrupole and the control and feedback circuitry.

Figure 10:
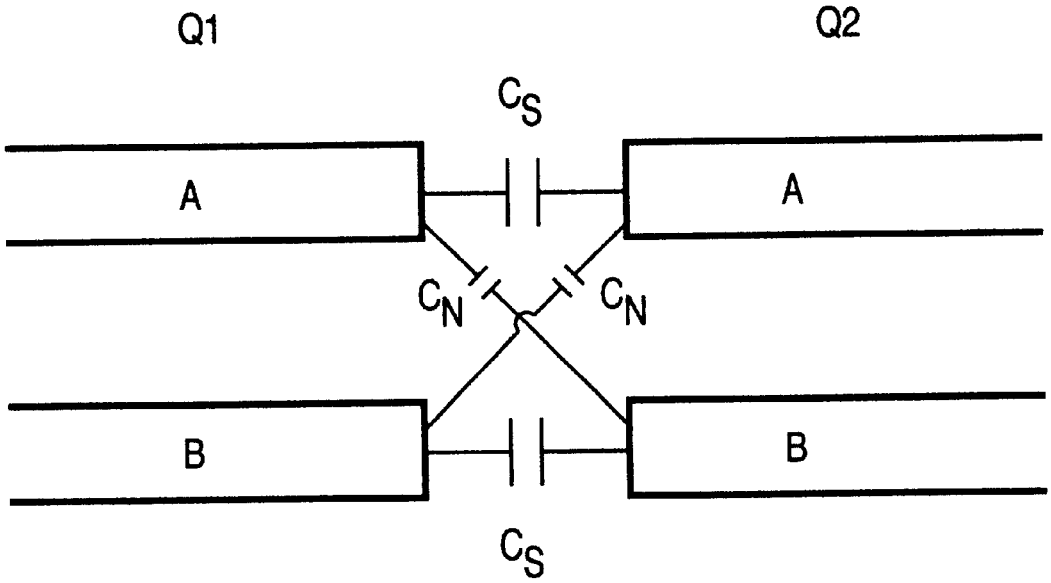
FIG. 10 is schematic showing the connection of neutralizing capacitors for close coupled quadrupoles according to the present invention.

To overcome the effect of the stray capacitance $C_s$, a technique of "neutralization" is used, as shown in FIG. 10. The quadrupoles are phase locked and the voltage applied to the A poles of quadrupole Q1 is the same polarity as the voltage applied to the A poles of quadrupole Q2. The quadrupoles may be phase locked by employing the same external RF drive 48, 60 to supply the RF signal for power supplies 34, 36, by synchronizing the respective internal oscillators 46, 58 or by using the same internal oscillator as oscillators 46,58. A neutralizing capacitor $C_N$ equal to the stray capacitance $C_S$ is installed between the A poles of quadrupole Q1 and the B poles of quadrupole Q2. Since the quadrupole are being operated in phase, the B poles of quadrupole Q2 will always be 180° out of phase with the A poles of quadrupole Q2. Capacitor $C_N$ will couple a voltage from the B poles of quadrupole Q2 to the A poles of quadrupole Q1. This voltage will have the same magnitude but opposite phase to the voltage coupled by the stray capacitance $C_s$ between the A poles of quadrupole Q2 and quadrupole Q1. Neutralizing capacitor $C_N$ will thereby cancel out the effect of the stray capacitance, and no net coupling remains between quadrupole Q2 and the A poles of quadrupole Q1 and, by identical reasoning, between quadrupole Q1 and the B poles of quadrupole Q2. Similarly a second neutralizing capacitor $C_N$ is installed between the B poles of quadrupole Q1 and the A poles of quadrupole Q2, leaving no net coupling between the quadrupole Q1 and the A poles of quadrupole Q2 and between quadrupole Q2 and the B poles of quadrupole Q1.

An additional capacitor, $C_N$, with a value equal to $C_S$, is used to couple a voltage from the B poles of quadrupole Q2 to the A poles of quadrupole Q1 equal in amplitude but opposite in polarity to that which the A poles of quadrupole Q1 receives from the A poles of quadrupole Q2 through the capacitance $C_S$. These two voltages exactly cancel and no net coupling remains between quadrupole Q2 and the A poles of quadrupole Q1. Similarly, a capacitor $C_N$ is connected between the A poles of quadrupole Q2 and the B poles of quadrupole Q1 to eliminate coupling between the B poles of quadrupoles Q1 and Q2. With this change to the RF excitation circuitry of the quadrupoles the feedback circuits functioned as intended.

It will be recognized that this method of neutralization is applicable to any circumstance in which adjacent quadrupole rod sets are positioned in close proximity without sufficient shielding to prevent the induction of cross-voltages due to stray capacitances between them and is not limited to the use of such adjacent quadrupole rod sets in series as a mass analyzer. Furthermore, this technique may be employed when more than two quadrupole rod sets are used in series, for example in a case where a third quadrupole rod set is used to further refine the resolution of the mass analyzer.

I claim:

1. A mass spectrometry apparatus comprising:

a. first and second multipole rod sets, each of said first and second multipole rod set having:

i. two or more positive rods, all of the positive rods being coupled together; and ii. two or more negative rods, all of the negative rods being coupled together;

b. a first voltage generator coupled to the positive and negative rods of said first multipole rod set for generating a potential in the first multipole rod set;

c. a second voltage generator coupled to the positive and negative rods of said second multipole rod set for generating a potential in the second multipole rod set;

d. a first capacitor coupled between the positive rods of said first multipole rod set and the negative rods of said second multipole rod set; and e. a second capacitor coupled between the negative rods of said first multipole rod set and the positive rods of said second multipole rod set.

2. The mass spectrometry apparatus of claim 1 wherein the first and the second voltage generators are capable of generating, in the first and second multipole rod sets, respectively, fields having a DC component and a RF component.

3. The mass spectrometry apparatus of claim 2 wherein the first and second multipole rod sets are axially aligned.

4. The mass spectrometry apparatus of claim 3 wherein the capacitance of the first capacitor is equal to a stray capacitance between the positive rods of the first and second multipole rod sets and the capacitance of the second capacitor is equal to a stray capacitance between the negative rods of the first and second multipole rod sets.

5. The mass spectrometry apparatus of claim 3 wherein the capacitance of the first capacitor is equal to a stray capacitance between the negative rods of the first and second multipole rod sets and the capacitance of the second capacitor is equal to a stray capacitance between the positive rods of the first and second multipole rod sets.

6. The mass spectrometry apparatus of claim 3 wherein the capacitance of the first and second capacitors is equal.

7. The mass spectrometry apparatus of claim 2 wherein the potentials generated by the first and second voltage generators in the first and second multipole rod sets, respectively, are selected such that the potentials at the positive rods of the first and second multipole rod sets are in phase and the potentials at the negative rods of the first and second multipole rod sets are in phase.

8. The mass spectrometry apparatus of claim 7 wherein the capacitance of the first and second capacitors is equal.

9. The mass spectrometry apparatus of claim 1 wherein each of the first multipole rod set and second multipole rod set is a quadrupole rod set.

* * * * *

UNITED STATES PATENT AND TRADEMARK OFFICE

CERTIFICATE OF CORRECTION

PATENT NO. : 6,340,814 B1 
DATED : January 22, 2002
INVENTOR(S) : Vandermey

It is certified that error appears in the above-identified patent and that said Letters Patent is hereby corrected as shown below:

Column 1,
Line 61, the word "lens-lenses," so that the sentence reads -- Also, for many quadrupole designs, one rod set is often enclosed in a chamber, with lenses at either end, so that it can be operated at a different pressure from adjacent rod sets. --

Figure 2:
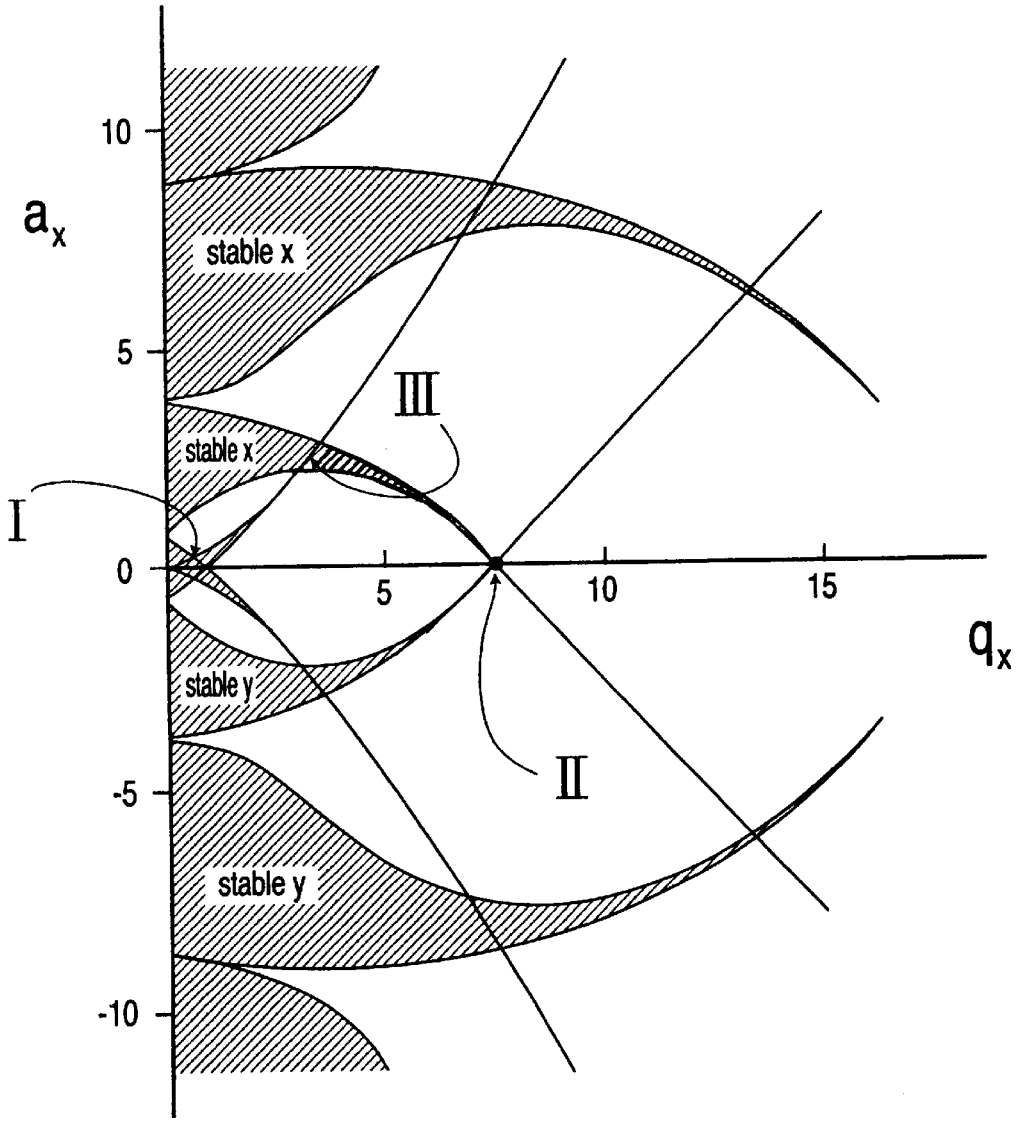
FIG. 2 is a conventional stability diagram showing different stability regions for a quadrupole mass spectrometer.

Column 3,
Line 12, the word "cross section" has been changed to -- cross-section --, so that the sentence reads -- The cross-section of rods 12, 14, 16 and 18 is preferably hyperbolic, although rods of circular cross-section are commonly used. --
Line 22, the word "rods" has been changed to -- rod --, so that the sentence reads -- The rod sets to which the positive DC potential is coupled may be referred to as the positive rods and those to which the negative DC potential is coupled may be referred to as the negative rods. --
Line 52, a -- " -- has been inserted in front of "Quadrupole" and after "Applications", so that the sentence reads -- The notation of FIG. 2 for the regions of stability is taken from "Quadrupole Mass Spectrometry and its Applications", P.H. Dawson ed., Elsevier Amsterdam, 1976. --

Column 4,
Line 48, the word "$Co^0$+ions" changed to -- $Co^+$ions --, so that the sentence reads -- Figure 4, for example, shows the peak shape obtained with operation at the upper tip of the third stability region, i.e. as in Figure 3a, and with ca. 120 eV $Co^+$ ions (m/e=59). --

UNITED STATES PATENT AND TRADEMARK OFFICE

CERTIFICATE OF CORRECTION

PATENT NO. : 6,340,814 B1 
DATED : January 22, 2002
INVENTOR(S) : Vandermey

It is certified that error appears in the above-identified patent and that said Letters Patent is hereby corrected as shown below:

Column 4 cont'd,
Line 53, the word "$Co^0$+ions" has been changed to -- $Co^+$ ions --, so that the sentence reads -- Similarly, Figure 5 shows the peak shape obtained with operation at the lower tip, i.e. as in Figure 3b, with 110 eV $Co^+$ ions. --
Line 55, the word "cutoff" has been changed to -- cut-off --, so that the sentence reads -- It is seen that there is a long tail on the peak, but here it is on the low mass side and the high mass side that has a relatively sharp cut-off. --
Line 62, the word "$Co^0$+ions" has been changed to -- $Co^+$ ions --, so that the sentence reads -- To eliminate the tails of Figures 4 and 5, two quadrupoles were operated in tandem and this has been demonstrated with $Co^+$ ions that had 120 eV energy in the first quadrupole and 110 eV energy in the second quadrupole. --

Column 6,
Line 28, a space has been inserted between -- 46,58 --, so that the sentence reads -- …by synchronizing the respective internal oscillators 46, 58 or by using the same internal oscillator as oscillators 46, 58. --
Line 31, the word "quadrupole" has been changed to -- quadrupoles --, so that the sentence reads -- Since the quadrupoles are being operated in phase, the B poles of quadrupole Q2 will always be 180° out of phase with the A poles of quadrupole Q2. --

Signed and Sealed this

Twenty-fifth Day of March, 2003

JAMES E. ROGAN
*Director of the United States Patent and Trademark Office*